US007182442B2

(12) United States Patent
Sheinman

(10) Patent No.: US 7,182,442 B2
(45) Date of Patent: Feb. 27, 2007

(54) INK JET PRINTING APPARATUS

(75) Inventor: Yehoshua Sheinman, RaAnana (IL)

(73) Assignee: Jemtex Ink Jet Printing Ltd., Lod (IL)

( * ) Notice: Subject to any disclaimer, the term of this patent is extended or adjusted under 35 U.S.C. 154(b) by 272 days.

(21) Appl. No.: 10/499,813

(22) PCT Filed: Dec. 31, 2002

(86) PCT No.: PCT/IL02/01064

§ 371 (c)(1),
(2), (4) Date: Jul. 1, 2004

(87) PCT Pub. No.: WO03/059626

PCT Pub. Date: Jul. 24, 2003

(65) Prior Publication Data

US 2005/0083381 A1 Apr. 21, 2005

Related U.S. Application Data

(60) Provisional application No. 60/343,587, filed on Jan. 2, 2002.

(51) Int. Cl.
*B41J 2/175* (2006.01)
*B41J 2/17* (2006.01)
*B41J 2/02* (2006.01)

(52) U.S. Cl. ..... 347/85; 347/84; 347/73

(58) Field of Classification Search ..... 347/1, 347/84–91, 20, 22, 29, 40–43, 73
See application file for complete search history.

(56) References Cited

U.S. PATENT DOCUMENTS 4,255,754 A * 3/1981 Crean et al. ..... 347/81
4,771,297 A * 9/1988 Lecheheb et al. ..... 347/29
5,105,205 A 4/1992 Fagerquist (Continued)

FOREIGN PATENT DOCUMENTS

EP 283226 A2 * 9/1988

(Continued)

OTHER PUBLICATIONS

Hartgerink et al. "Self-Assembling Peptide Nanotubes", J. Am. Chem. Soc., 118: 43-50, 1996.

(Continued)

*Primary Examiner*—Manish S. Shah
*Assistant Examiner*—Kainoa Wright

(57) ABSTRACT

Ink jet printing apparatus includes a linear array of jet modules each having an inlet for receiving ink, an outlet for re-circulating the ink, a nozzle for discharging ink in the form of droplets, and a perturbation device for causing a continuous stream of ink droplets to be discharged from the respective nozzle. The apparatus further includes an ink supply system having an inlet manifold, an outlet manifold, and a plurality of connecting passageways connecting the jet modules in parallel between the inlet and outlet manifolds. The connecting passageways connect the inlet of each jet module to the inlet manifold and the outlet of each jet module to the outlet manifold, such as to define a T-connection of each jet module with the inlet and outlet manifolds. Such a construction reduces the mass of each jet module thereby permitting printing at higher frequencies and with smaller ink droplets.

20 Claims, 9 Drawing Sheets

U.S. PATENT DOCUMENTS

| | | | | |
|---|---|---|---|---|
| 5,535,494 | A * | 7/1996 | Plesinger et al. | 29/25.35 |
| 6,250,738 | B1 | 6/2001 | Waller et al. | |
| 2002/0012034 | A1 * | 1/2002 | Saikawa | 347/93 |
| 2002/0180835 | A1 * | 12/2002 | Boyd et al. | 347/42 |

FOREIGN PATENT DOCUMENTS

| | | | |
|---|---|---|---|
| WO | WO 9817476 | A1 * | 4/1998 |
| WO | WO 99/58652 | | 11/1999 |
| WO | WO 2004/052773 | | 6/2004 |
| WO | WO 2004/060791 | | 7/2004 |
| WO | WO 2005/031362 | | 7/2005 |

OTHER PUBLICATIONS

Ajayan et al. "Applications of Carbon Nanotubes", Topics Appl. Phys., 80: 391-425, 2001.
Görbitz "Nanotube Formation by Hydrophobic Dipeptides", Chemistry, 7(23): 5153-5159, 2001.
Reches et al. "Amyloid Fibril Formation by Pentapeptide and Tetrapeptide Fragments of Human Calcitonin", Journal of Biological Chemistry, 277(38): 35475-35480, 2002.
Haldar et al. "First Crystallographic Signature of the Highly Ordered Supramolecular Helical Assemblage From A Tripeptide Containing A Non-Coded Amino Acid", Tetrahedron Letters, 43(14): 2653-2656, 2002.
Maji et al. "Fibril-Forming Model Synthetic Peptides Containing 3-Aminophenylacetic Acid", Tetrahedron, 58(43): 8695-8702, 2002.
Hartgerink et al. "Peptide Nanotubes and Beyond", Chemistry, A European Journal, 4(8): 1367-1372, 1998.
Ghadiri et al. "Self-Assembling Organic Nanotubes Based on A Cyclic Peptide Architecture", Nature, 366: 324-327, 1993.
Horne et al. "A Heterocyclic Peptide Nanotube", Journal of the American Chemical Society, 125(31): 9372-9376, 2003.
Reches et al. "Casting Metal Nanowires Within Discrete Self-Assembled Peptide Nanotubes", Science, 300(5619): 625-627, 2003.
Adekore et al. "Carbon Nanotubes", pp. 1-11, 2001.
Brauer "GB-245 Nanotubes: Directions and Techno", BCC, 2000.
Martin et al. "The Emerging Field of Nanotube Biotechnology", Nature Reviews, 2: 29-37, 2003.
Zhang et al. "Design of Nanostructured Biological Materials Through Self-Assembly of Peptides and Proteins", Current Opinion in Chemical Biology, 6: 865-871, 2002.
Daenen et al. "The Wondrous World of Carbon Nanotubes", p. 1-8, 2003.
Grady et al. "Axe-Txe, A Broad-Spectrum Proteic Toxin-Antitoxin System Specified by a Multidrug-Resistant, Clinical Isolate of Enterococcus Faecium", Molecular Biology, 47(5): 1419-1432, 2003. Abstract p. 1424, col. 1-p. 1426, col. 2, Fig. 5.
Cherny et al. "The YefM Antitoxin Defines A Family of Natively Unfolded Proteins", The Journal of Biological Chemistry, 279(9): 8252-8561, 2004.
Engelberg-Kulka et al. "Bacterial Programmed Cell Death Systems as Targets for Antibiotics", Trends in Microbiology, 12(2): 66-71, 2004.

* cited by examiner

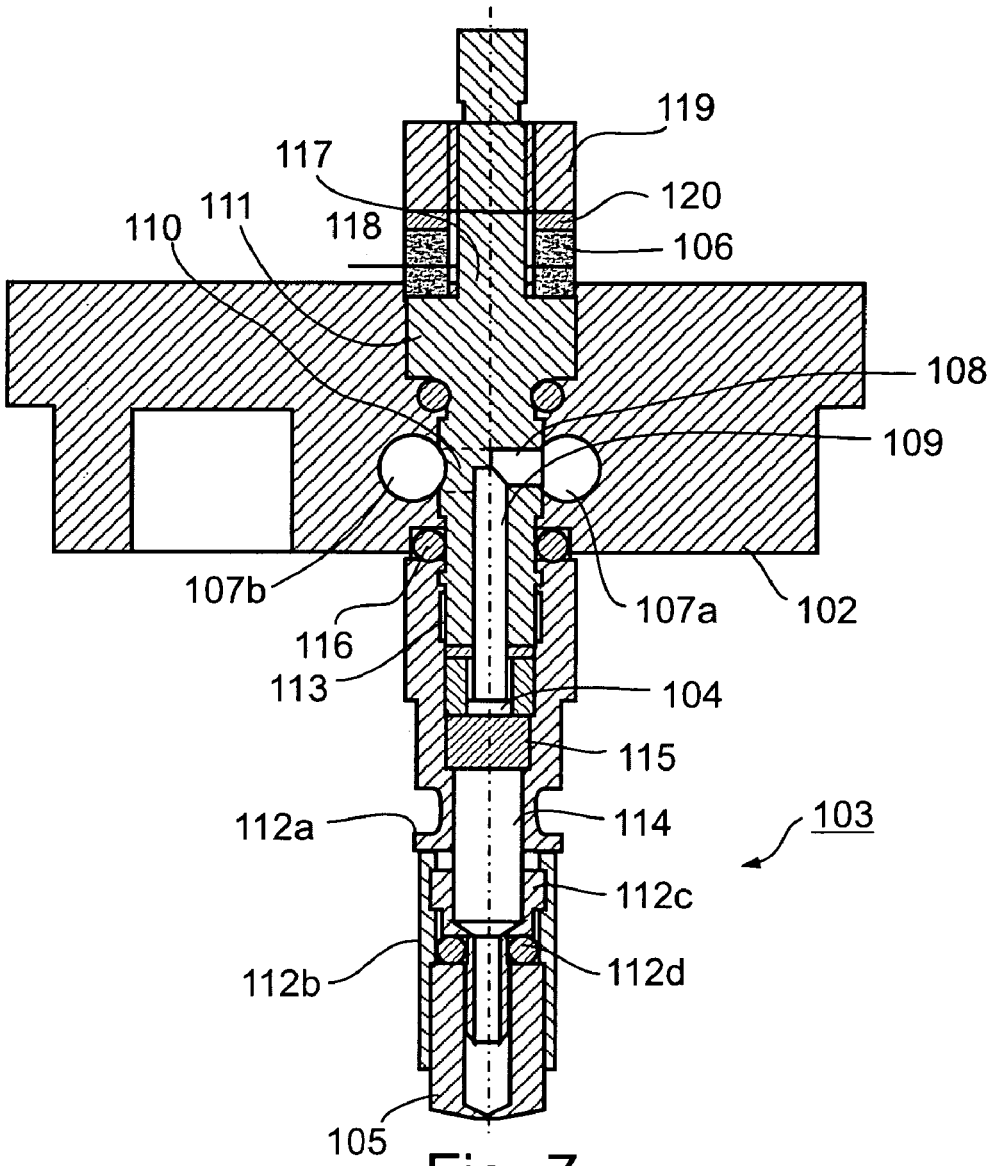
Fig. 7
Fig. 8
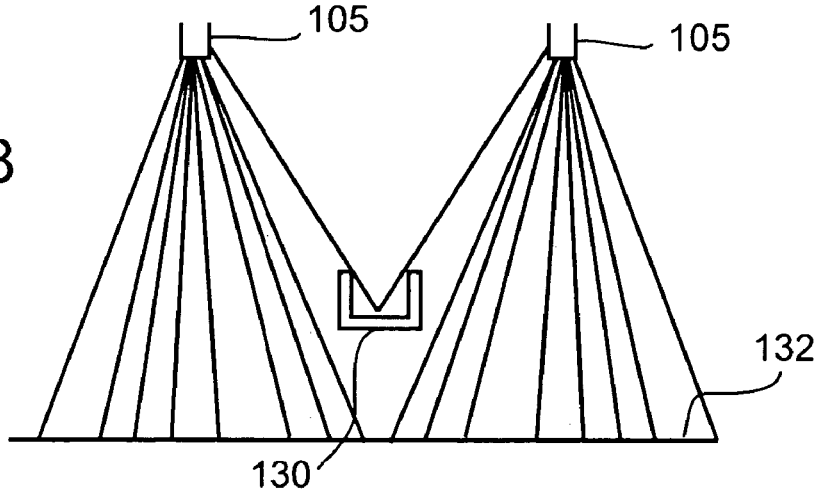

INK JET PRINTING APPARATUS

RELATED PATENT APPLICATION

This application is a National Phase Application of PCT/IL02/01064 International Filing Date 31 Dec. 2002, which claims priority from U.S. Provisional Patent Application Ser. No. 60/343,587 filed 2 Jan. 2002.

FIELD AND BACKGROUND OF INVENTION

The present invention relates to ink jet printing apparatus of the type described in our prior U.S. Pat. Nos. 5,969,733, 6,003,980 and 6,106,107, and also in our prior International Patent Application No. PCT/IL02/00346 filed May 3, 2002, published on Nov. 14, 2002 as International Publication No. WO 02/090119 A2, the contents of which patents and application are incorporated herein by reference.

Ink jet printers are based on forming droplets of liquid ink and selectively depositing the ink droplets on a substrate. The known ink jet printers generally fall into two categories: drop on-demand printers, and continuous-jet printers. Drop on-demand printers selectively form and deposit the ink jet droplets on the substrate as and when demanded by a control signal from an external data source; whereas continuous-jet printers are stimulated by a perturbation device, such as piezoelectric transducer, to form the ink droplets from a continuous ink jet filament at a rate determined by the perturbation device.

In continuous-jet printers, the droplets are selectively charged and deflected to direct them onto the substrate according to the desired pattern to be printed. In binary-type printer systems, the droplets are either charged or uncharged and, accordingly, either reach or do not reach the substrate at a single predetermined position. In a multi-level system, the droplets can receive a large number of charge levels and, accordingly, can generate a large number of print positions. Both types of systems generally include a gutter for receiving the ink droplets not to be printed on the substrate.

The present invention is particularly applicable to continuous-jet printers and is therefore described below with respect to this application. It will be appreciated, however, that aspects of the invention could also be used in droplet-on-demand printers or in other applications.

The conventional continuous-jet printer of the type described in the above-cited patents and International Application comprises a linear array of jet modules each including an inlet for receiving: ink, an outlet for re-circulating the ink, a nozzle for discharging ink in the form of droplets, and a perturbation device, such as a piezoelectric transducer, for causing a continuous stream of droplets to be discharged from the respective nozzle. Such apparatus further comprises an ink supply system including an inlet manifold, an outlet manifold, and a plurality of connecting passageways connecting the jet module inlets in parallel between the inlet and outlet manifolds. In one prior art construction of such printing apparatus, the connecting passageways define an F-connection of each jet module with the inlet and outlet manifolds.

Such a prior art construction is more particularly described below with respect to FIGS. 1–4 of the accompanying drawings. One drawback in such a prior art construction is that the jet modules have relatively large mass which undesirably affects the printing resolution. Thus, for high quality printing, it is desirable to print with very small ink droplets, at relatively high frequencies, and with relatively close spacings between the jet modules. Jet modules with relatively high masses, such as in the prior art construction illustrated in FIGS. 1–4, limit all three of the above objectives for high quality printing.

Another drawback in the prior art construction illustrated in FIGS. 1–4 is the tendency of the nozzles to become clogged, and the difficulty in cleaning the nozzles at the printing site without requiring major disassembly of the jet modules.

OBJECTS AND BRIEF SUMMARY OF THE PRESENT INVENTION

An object of the present invention is to provide jet printing apparatus having advantages in one or more of the above respects.

According to one aspect of the present invention, there is provided an ink jet printing apparatus comprising: a linear array of jet modules each including an inlet for receiving ink, an outlet for re-circulating the ink, a nozzle for discharging ink in the form of droplets, and a perturbation device for causing a continuous stream of ink droplets to be discharged from the respective nozzle; and an ink supply system including an inlet manifold, an outlet manifold, and a plurality of connecting passageways connecting the jet modules in parallel between the inlet and outlet manifolds; characterized in that the inlet and outlet manifolds are formed in a body member exposed in alignment with the linear array of jet modules and formed with a plurality of bores for receiving the linear array of jet modules; characterized in that the inlet and outlet manifolds are formed in a body member exposed in alignment with the linear array of jet modules and formed with a plurality of bores for receiving the linear array of jet modules; and in that the connecting passageways connect the inlet of each jet module to the inlet manifold and the outlet of each jet module to the outlet manifold, such as to define a T-connection of each jet module with the inlet and outlet manifolds.

As will be described more particularly below, such a construction, wherein a T-connection rather than an F-connection is made of each jet module with the inlet and outlet manifolds, enables a significant reduction in the mass of each jet module, as well as a closer spacing between jet modules, to be made such as to enhance the printing quality.

In the described preferred embodiments, each of the jet modules has a vertically-extending longitudinal axis, and the inlet and outlet manifolds both have longitudinal axes extending horizontally, parallel to each other in a common horizontal plane on opposite sides of the jet modules.

According to further features in the described preferred embodiments, the body member is further formed with a linear array of nozzle inlets for said linear array of jet modules, said plurality of connecting passageways including one group from said nozzle inlets to said inlet manifold, and a second group from said nozzle inlets to outlet manifold. More particularly, each of the jet modules is formed with a T-shaped connecting passageway having a horizontal leg communicating at its opposite ends with the inlet and outlet manifolds, and a vertical leg centrally off the horizontal leg and leading to its respective nozzle.

According to further features in the described preferred embodiments, the perturbation device for each jet module is a piezoelectric transducer, and each jet module is further formed with a mounting for the piezoelectric transducer above the jet module inlet. In addition, each jet module further includes a counterweight supported thereon above the piezoelectric transducer.

According to one described preferred embodiment, the mounting device is formed with a linear array of bores receiving the linear array of jet modules with the inlet and outlet manifolds of the mounting member located on opposite sides of the jet modules.

According to a second described preferred embodiment, the mounting device includes two sections secured together with the array of jet modules inbetween. One of the sections includes the inlet manifold in the form of a continuous channel plugged at its opposite ends, and the other section includes the outlet manifold also in the form of a continuous channel plugged at its opposite ends. Each of the sections is formed with an opening for each of the jet modules and includes a pin in each opening formed with a connecting passageway connecting the respective manifold to the respective side of the jet module.

Preferably, the two sections of the mounting device are made of a plastic material having a relatively low mass (as compared to metal). Such a construction enables the mass of the jet modules to be reduced, thereby permitting the printing to be effected with small ink droplets at relatively high frequencies for purposes of enhancing the printing quality; at the same time such a construction permits the jet modules to have a relatively large space between them if desired in order to reduce the overall cost of the printer apparatus.

According to another aspect of the present invention, there is provided an ink jet printing apparatus, comprising: a linear array of jet modules each including an inlet for receiving ink, an outlet for re-circulating the ink, a nozzle for discharging ink in the form of droplets, and a perturbation device for causing a continuous stream of ink droplets to be discharged from the respective nozzle; and an ink supply system including a a body member formed with-an inlet manifold, an outlet manifold, and a plurality of connecting passageways connecting the jet modules in parallel between the inlet and outlet manifolds; each of the nozzles being removably attached to the jet module by a coupling sleeve fixed to the body member and formed with internal threads engageable with external threads formed in the jet module to permit convenient detaching of the nozzle for cleaning purposes. The foregoing features enable each nozzle to be conveniently disassembled and cleaned as and when needed at the printing site, and thereby obviate the need for large down times or removal of the apparatus from the printing site for cleaning purposes. The foregoing features enable each nozzle to be conveniently disassembled and cleaned as and when needed at the printing site, and thereby obviate the need for large down times or removal of the apparatus from the printing site for cleaning purposes.

According to a further aspect of the present invention, there is provided ink jet printing apparatus comprising a linear array of jet modules each including an inlet for receiving ink, an outlet for re-circulating the ink, a nozzle for discharging ink in the form of droplets, and a perturbation device for causing a continuous stream of ink drops to be discharged from the respective nozzle. Each of the jet modules is equally spaced from each other in the linear array. The apparatus further comprises an ink supply system including an inlet manifold, an outlet manifold, and a plurality of connecting passageways connecting the jet modules in parallel between the inlet and outlet manifolds; and a gutter in every other space between the jet modules such that each gutter is shared by two jet modules on its opposite sides. The foregoing features not only decrease the cost of the printing apparatus but also enable the printing apparatus to be constructed more compactly, thereby enhancing printing quality.

Further features and advantages of the invention will be apparent from the description below.

BRIEF DESCRIPTION OF THE DRAWINGS

The invention is described herein, by way of example only, with reference to the accompanying drawings, wherein:

FIGS. 5, 6, 7 and 8 are views corresponding to FIGS. 1, 2, 3 and 4, respectively, illustrating one embodiment of ink jet printing apparatus constructed in accordance with the present invention;

Figure 1:
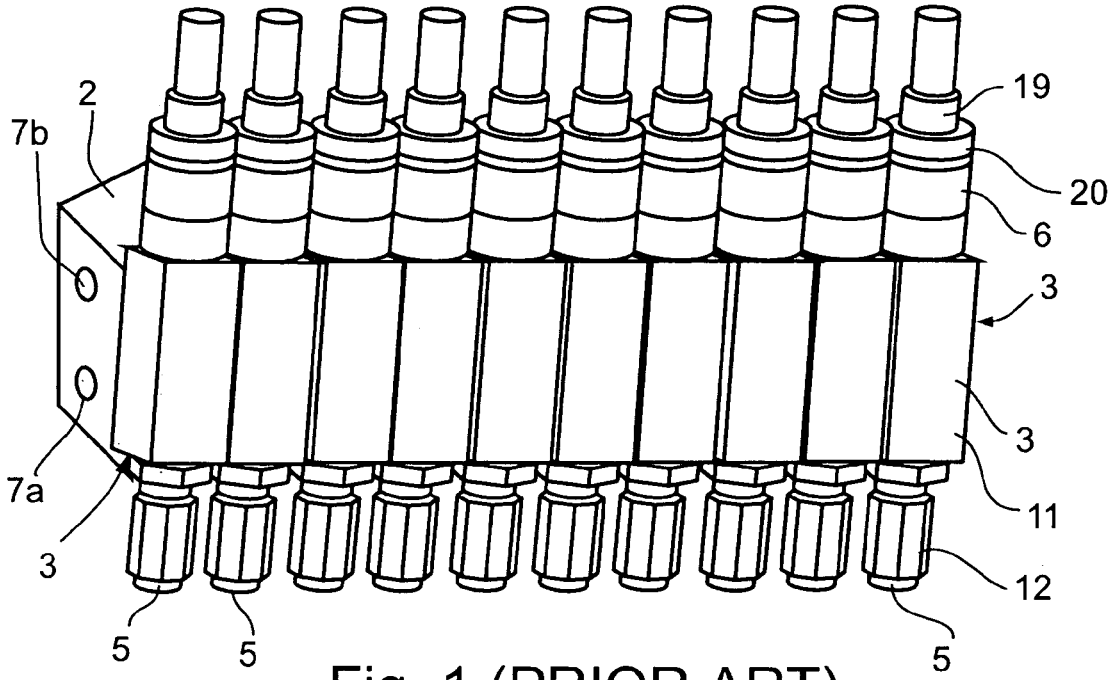
Fig. 1 (PRIOR ART)
FIGS. 1–4 illustrate a known prior art construction of jet printing apparatus, FIG. 1 being a three-dimensional view of the printer head assembly in such apparatus, FIG. 2 being a side elevational view of FIG. 1, FIG. 3 being a longitudinal sectional view through one jet module, and FIG. 4 diagrammatically illustrating the arrangement of gutters between jet modules.
Figure 2:
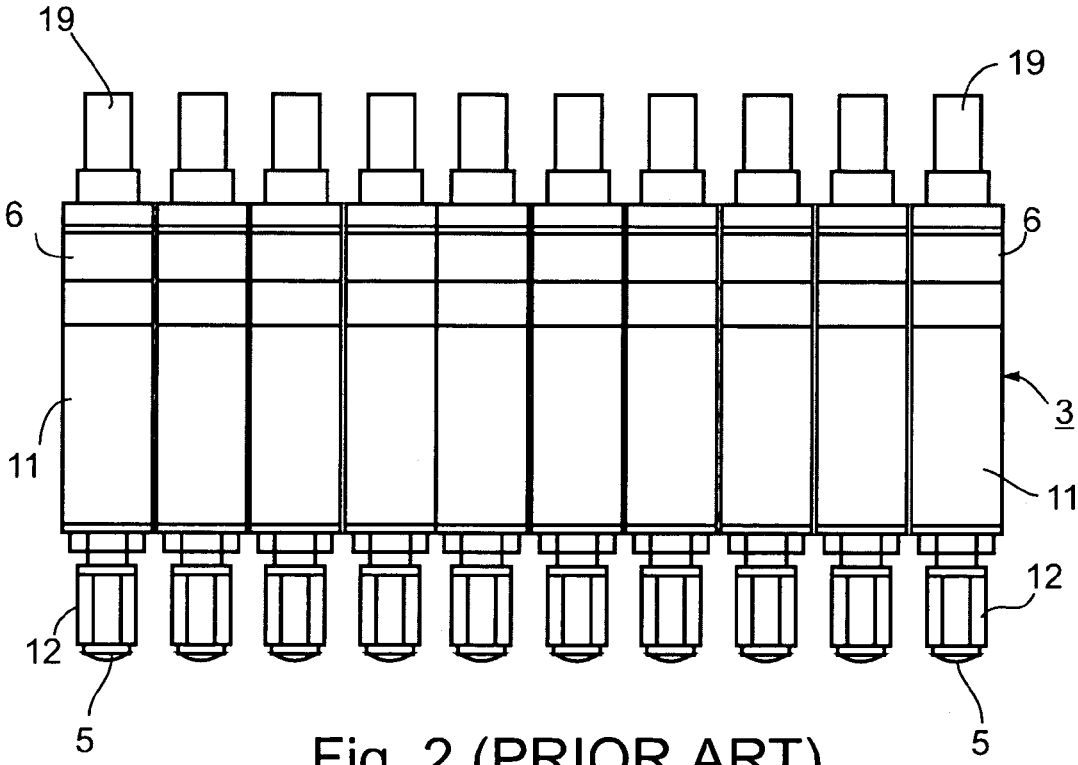
Fig. 2 (PRIOR ART)

It is to be understood that the foregoing drawings, and the description below, are provided primarily for purposes of facilitating understanding the conceptual aspects of the invention and various possible embodiments thereof, including what is presently considered to be a preferred embodiment. In the interest of clarity and brevity, no attempt was made to provide more details than necessary to enable one skilled in the art, using routine skill and design, to understand and practice the described invention. It is to be further understood that the embodiments described are for purposes of example only, and that the invention is capable of being embodied in other forms and applications than described herein.

Prior Art Construction of FIGS. 1–4

FIGS. 1–4 illustrate a printer head assembly of a known prior art construction used in continuous-jet printers. As shown particularly in FIG. 1, the illustrated printer head assembly includes a common mounting member 2 mounting a linear array of jet modules 3 along equally-spaced vertical axes. As shown particularly in FIG. 3, each jet module 3 includes a nozzle inlet 4 for receiving ink, a nozzle 5 for discharging ink in the form of droplets, and a perturbation device 6 for causing a continuous stream of ink droplets to be discharged from the respective nozzle 5.

The ink is supplied to all the jet modules in parallel from a common reservoir (not shown). For this purpose, the common mounting member 2 is formed with an inlet manifold 7*a* (FIG. 1) and an outlet manifold 7*b*. Inlet manifold 7*a* is connected to the inlet 8 of each jet module leading to its nozzle inlet 4. Each jet module further includes a passageway 9 leading from the nozzle inlet 4 to the jet module outlet 10 for re-circulating the ink to the outlet manifold 7*b*.

In the prior art construction illustrated in FIGS. 1–4, the connecting passageways 8, 9, 10 define an F-connection of each jet module with the inlet manifold 7*a* and outlet manifold 7*b* of mounting member 2. Thus, as shown in FIG. 1, the two manifolds 7*a*, 7*b* are vertically aligned with each other; similarly, the inlet 8 and outlet 10 of each jet module 3 are vertically aligned with each other and are connected together by passageway 9. In the assembly of jet modules, the common mounting member 2 extends laterally of the line of jet modules 3, with the inlet manifold 7*a* communicating with the inlet 8 of each jet module, and the outlet manifold 7*b* communicating with the outlet 10 of each jet module. The jet modules are thus connected in parallel to the inlet manifold 7*a* and outlet manifold 7*b* via F-connections each defined by the horizontal inlet 8, the vertical connecting passageway 9, and the horizontal outlet 10, as shown particularly in FIG. 3.

Passageways 8, 9, 10 of each jet module 3 are formed in a body member 11 of each jet module 3. In the illustrated construction, the nozzle 5 is fixed to the lower end of a holder 12 threadedly received at 13 in the lower end of body member 11 of the respective jet module. The nozzle inlet 4 communicates with nozzle 5 via a passageway 14 extending through the nozzle holder 12. The nozzle holder further includes a filter 15 for removing solid particles from the liquid supplied to the nozzle, and an O-ring 16 for sealing the coupling between body member 11 and the nozzle holder 12.

The opposite end of body member 11 of each jet module 3 is formed with a vertically-extending stem 17 for mounting the perturbation device 6 of the respective jet module. In the illustrated construction, the perturbation device 6 is a piezoelectric transducer electrically driven by an electrode 18 connected to a voltage source (not shown), and grounded via the jet module, which is of metal. Stem 17 further mounts a counter-weight 19 separated from the piezoelectric transducer 6 by a separator disc 20.

Figure 3:
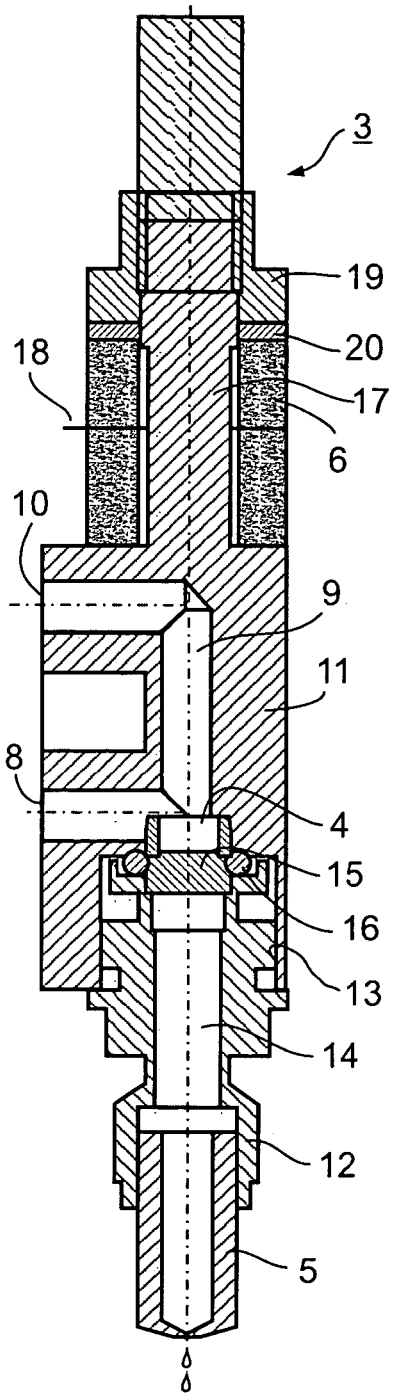
Fig. 3 (PRIOR ART)
Figure 4:
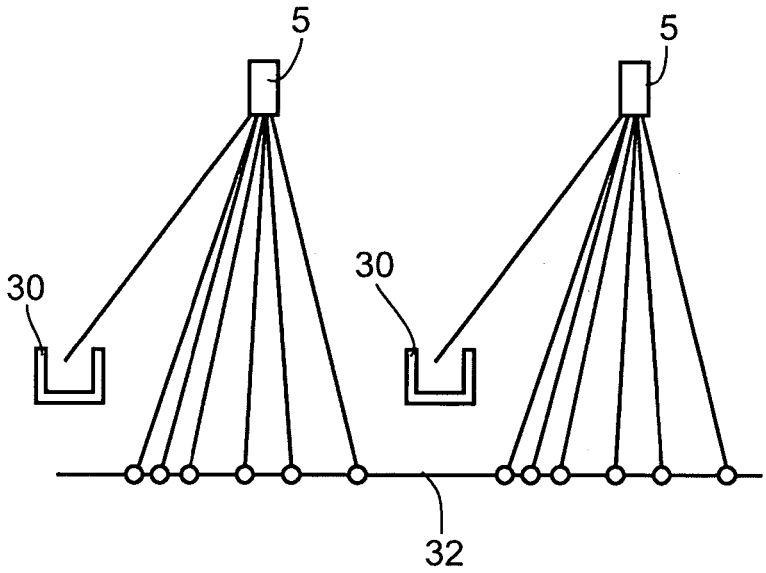
Fig. 4 (PRIOR ART)

In the prior art printing apparatus illustrated in FIGS. 1–4, the linear array of jet modules 3 are equally spaced from each other; and a gutter 30 (FIG. 4) is provided in each of the spaces between the nozzles, as shown in FIG. 4. Thus, during the operation of the ink jet printer, as described more particularly in the above-cited patents and International Application incorporated herein by reference, the piezoelectric transducer 6 of each jet module causes each nozzle to discharge a continuous stream of ink droplets towards the substrate 32. Each of the ink droplets is charged and deflected (by electrodes not shown herein) to its proper location on the substrate according to the data to be printed; and if a mark is not to be printed, the droplet is deflected to its respective gutter 30 located laterally of nozzle 5 of the respective jet module.

As briefly described earlier, the prior art ink jet printer illustrated in FIGS. 1–4 has a number of drawbacks, which are avoided by the present invention as described below with respect to FIGS. 5–13. One drawback is that the F-connection described above of each jet module 3 with the inlet manifold 7*a* and outlet manifold 7*b*, supplying the ink to all the jet modules in parallel, results in a relatively large mass in each jet module. This limits the operating frequency, and also the ink droplet size, of the ink jet printer. The printer quality is thereby affected, as indicated earlier, since the print quality or resolution is enhanced by increasing the operating frequency and decreasing the size of the ink droplets.

The quality of printing is also enhanced by close spacing of the nozzles. In the prior art construction illustrated by FIGS. 1–4, the center lines of the nozzles are generally spaced about 8 mm apart. A closer spacing of the nozzles would enable higher quality printing as well as a more compact printing head. In the prior construction, the jet printing apparatus generally includes two printing head assemblies, each as described above with respect to FIGS. 1–4, with the nozzles of one assembly staggered with respect to the other assembly to enhance the printing quality, but even more close spacing between the nozzle center lines would even further enhance the printing quality.

A still further drawback in the prior art apparatus illustrated in FIGS. 1–4 is the difficulty in cleaning the nozzles 5 at the printing site without requiring major disassembly of the print head. Thus, it was found that dirt accumulating within passageway 14 was particularly difficult to remove and significantly affected the operation of the apparatus unless it was thoroughly cleaned. This generally required substantial down-time of the apparatus and/or removal of the apparatus for cleaning purposes.

As also indicated earlier, and as shown in FIG. 4, the prior art apparatus illustrated in FIGS. 1–4 includes a separate gutter 30 for each nozzle 5. Such an arrangement increases the size of the printer head assembly, and also the cost of its manufacture.

DESCRIPTION OF PREFERRED EMBODIMENTS OF THE INVENTION

The present invention, as described below with respect to the embodiments of FIGS. 5–8, 9–12 and 13, respectively, improves the jet printing apparatus in one or more of the above respects.

The Embodiment of FIGS. 5–8

The embodiment illustrated in FIGS. 5–8 includes improvements over the prior art construction of FIGS. 1–4 in all of the above respects. To facilitate understanding the embodiment of FIGS. 5–8, the elements thereof corresponding to the prior art construction of FIGS. 1–4 will generally be identified by the same reference numerals as in FIGS. 1–4, but increased by "100".

Thus, the apparatus illustrated in FIGS. 5–8 also includes a common mounting member 102 for mounting a linear array of jet modules 103 each including an inlet 108 (FIG. 7) for receiving ink, an outlet 110 (shown in phantom in FIG. 7) for re-circulating the ink, a nozzle 105 for discharging ink in the form of droplets, and a perturbation device in the form of a piezoelectric transducer 106 for causing a continuous stream of ink droplets to be discharged from the respective nozzle. For this purpose, the common mounting member 102 is formed with an inlet manifold 107*a* connected to an ink reservoir (not shown) for supplying the ink to all the jet module inlets 108 in parallel, and with an outlet manifold 107*b*.

In this case, however, the jet modules 102 are connected in parallel between the manifold inlet 107*a* and the manifold outlet 107*b*, not by F-connections as described above with respect to FIGS. 1–4, but rather by T-connections. For this purpose, the common mounting member 102 is not disposed laterally of the linear array of jet modules 103, but rather is formed with a plurality of bores for receiving the linear array of jet modules 103, as shown particularly in FIGS. 6 and 7. In addition, the inlet and outlet manifolds 107*a*, 107*b* are not vertically aligned with each other, but rather are horizontally aligned. Further, as shown particularly in FIG. 7, the inlet manifold 107*a* communicates with the jet module horizontal inlet 108; the vertically-extending passageway 109 leading to nozzle inlet 104, and the jet module horizontal outlet (shown in phantom in FIG. 7 at 110), coaxial with inlet 108 and communicating with the manifold outlet 107*b* for re-circulating the ink. The foregoing passageways 108, 109 and 110, communicating with the inlet manifold 107*a*, the nozzle inlet 104, and the outlet manifold 107*b* are all formed in body member 111 of the respective jet module 103.

The foregoing construction, including a T-connection between each jet module 103 with the inlet manifold 107*a* and outlet manifold 107*b*, enables the mass of each jet module to be significantly reduced, thereby permitting operation of the printer at higher frequencies and with smaller droplets. In addition, such a construction permits closer spacing of the center lines of the jet modules, if desired, for further enhancing the print quality. For example, whereas the prior art construction of FIGS. 1–4 provided a spacing of 8 mm, the construction of FIGS. 5–8 permits a spacing of 5 mm.

As further shown in FIG. 7, each jet module also includes a holder for the respective nozzle 105 and removably attached to the body member 111 by threads 113 formed with a passageway 114 connecting the nozzle inlet 104 of the respective jet module to its nozzle 105. Passageway 114 includes a filter 115 for removing dirt particles from the ink before reaching the nozzle. In this case, however, the holder for the nozzle 105 is made of two sections 112*a*, 112*b* attachable to each other by threads 112*c*, with holder section 112*b* receiving an O-ring 112*d* at its connection with the respective nozzle 105. Such a construction conveniently permits both the nozzle 105, and its holder 112*a*–112*c* to be removed from the jet module, and the nozzle 105 to be removed from its holder, for cleaning purposes whenever desired, thereby avoiding long down-time periods that would be required for otherwise cleaning these elements at the printing site, or for removing the apparatus to another location for cleaning purposes.

Figure 5:
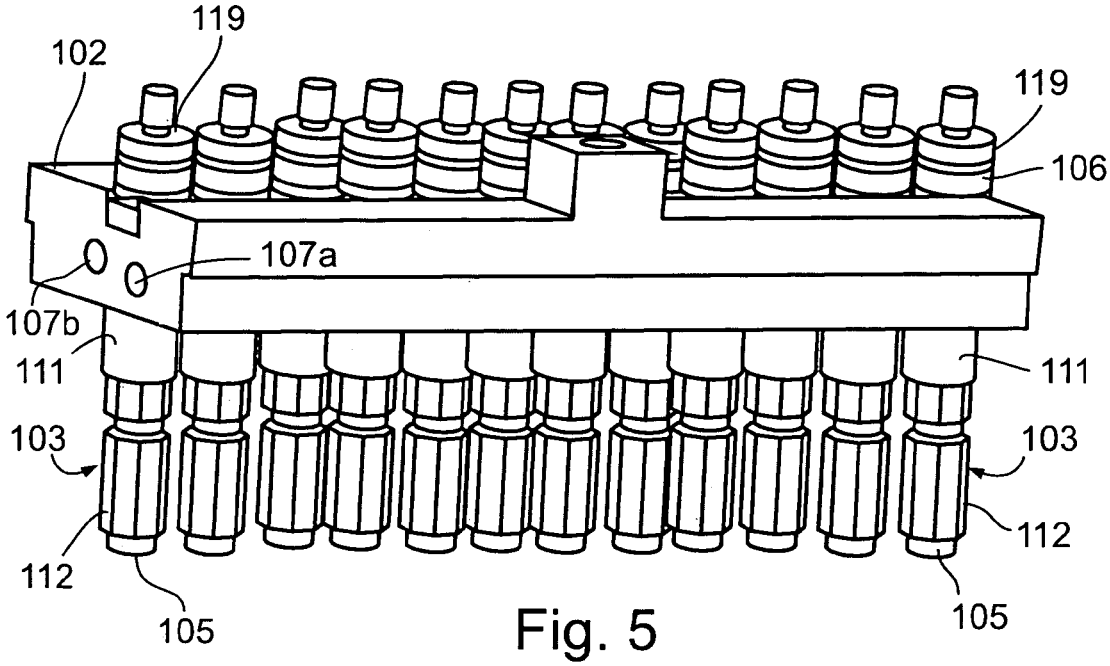
Figure 6:
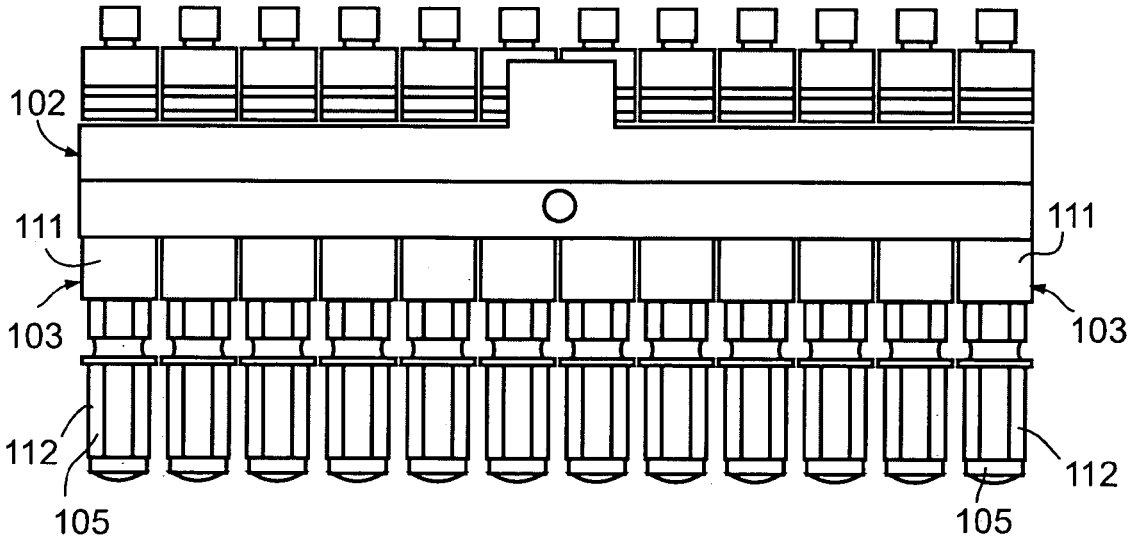
Figure 9:
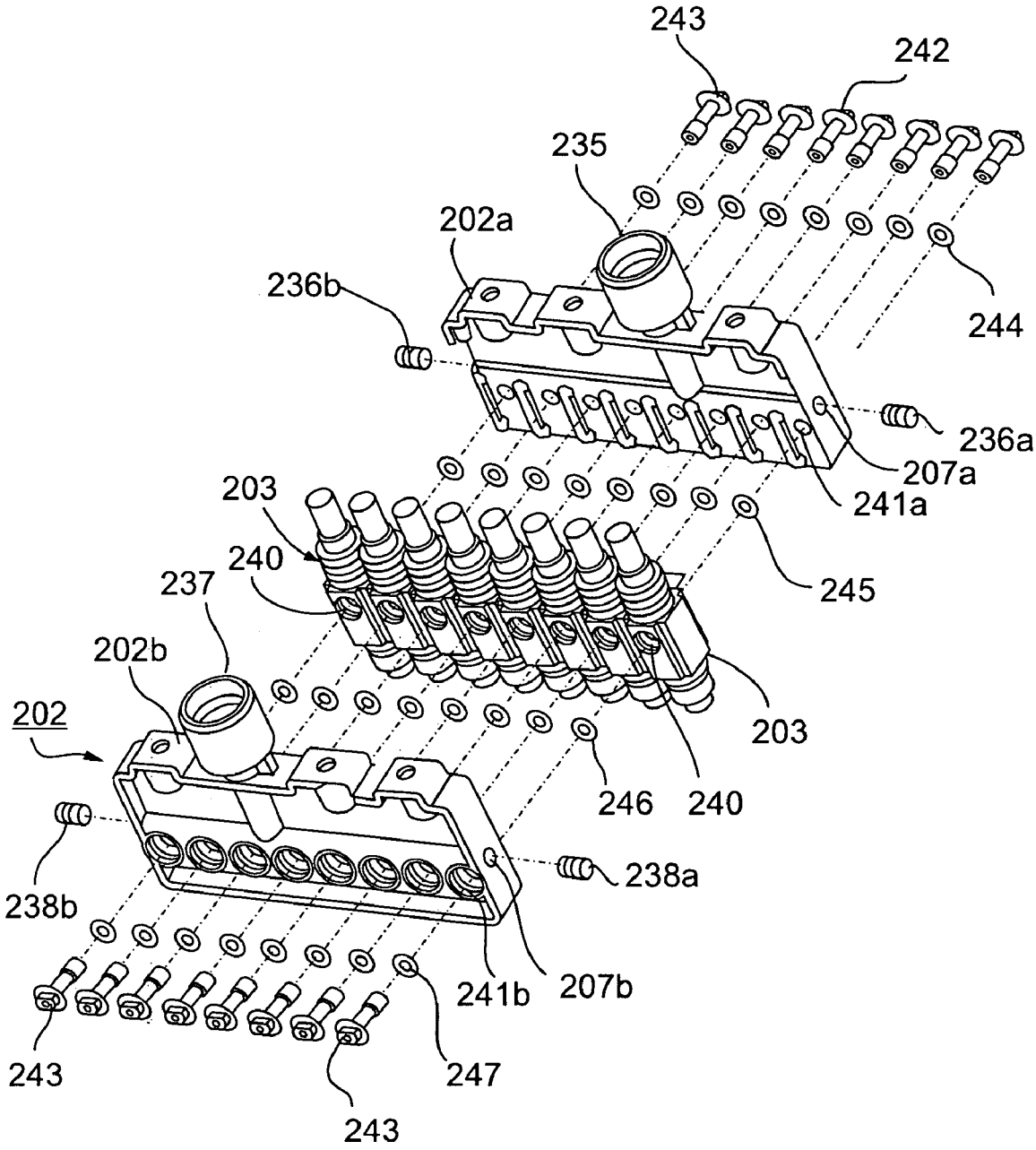
FIGS. 9–12 illustrate a second embodiment of ink jet printing apparatus constructed in accordance with the present invention, FIG. 9 being an exploded view of the printer head assembly, FIG. 10 being a sectional view through one jet module, FIG. 11 being an enlarged fragmentary view of a portion of FIG. 11, and FIG. 12 being a sectional view along line XII—XII of FIG. 11.

The jet modules illustrated in FIGS. 5–7 may otherwise be of substantially the same construction as described above with respect to FIGS. 1–4, including a stem 117 at the opposite to the nozzle 105 for mounting the piezoelectric transducer 106 driven by electrode 118, and a counterweight 119 separated from the piezoelectric transducer by a separator disc 120.

As indicated earlier, and as shown in FIG. 4, the prior art printer includes a separate gutter 30 for each nozzle 5, which increases the size of the printer head assembly and also the cost of its manufacture. This drawback is avoided in the manner illustrated FIG. 8, wherein it will be seen that the apparatus includes a gutter 130 which is shared by each pair of jet module nozzles 105. Thus, in the construction illustrated in FIG. 8, a gutter would be provided in every other space between the jet modules such that each gutter is shared by two jet modules on its opposite sides, thereby substantially reducing the size of the printer head assembly as well as of its cost of manufacture.

The Embodiment of FIGS. 9–12

FIGS. 9–12 illustrate a second embodiment of the invention which is, in many respects, similar to that of FIGS. 5–8. To facilitate understanding, therefore, those elements in FIGS. 9–12 which generally correspond with those of FIGS. 5–8 are identified by the same reference numerals, but in the "200" series.

Thus, the embodiment of FIGS. 9–12 also includes a mounting device, generally designated 202, for mounting a linear array of jet modules 203. In this case, however, mounting device 202 is constituted of two sections 202*a*, 202*b* secured together with the array of jet modules 203 inbetween. The two sections 202*a*, 202*b* are both made of plastic material having relatively low mass as compared to the metal of the jet modules. Such a construction thus permits the overall mass of each jet module to be reduced, thereby allowing operation at higher frequencies and with smaller droplet sizes; at the same time, this construction enables a larger spacing to be produced between the jet modules when desired for purposes of reducing the overall cost of the jet modules.

As in FIGS. 5–8, each jet module 203 includes a nozzle inlet 204 (FIG. 10) for receiving ink, a nozzle 205 for discharging ink in the form of droplets, and a perturbation device, in the form of a piezoelectric transducer 206, for causing a continuous stream of ink droplets to be discharged from the respective nozzle. The ink is supplied to the nozzle inlets 204 by an ink supply system including an inlet manifold, in the form of a passageway 207*a* in mounting section 202*a*, an outlet manifold in the form of a passageway 207*b* in mounting section 202*b*, and a plurality of connecting passageways, as to be described below, connecting the nozzle inlets 204 in parallel between the inlet and outlet manifolds. As will also be described below, such connecting passageways connect each jet module between the inlet manifold 207*a* and the outlet manifold 207*b* by a T-connection.

Figure 10:
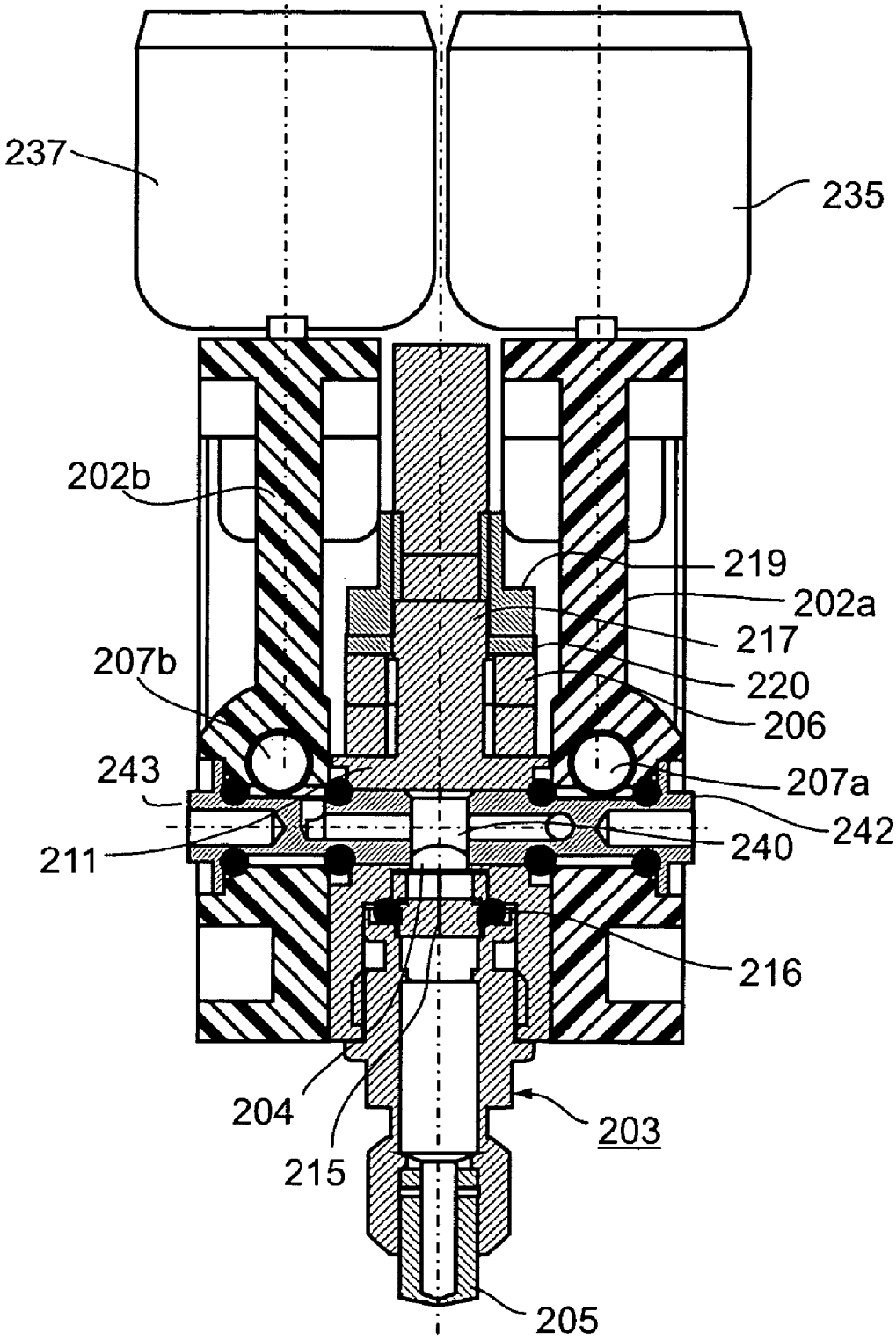
Figure 11:
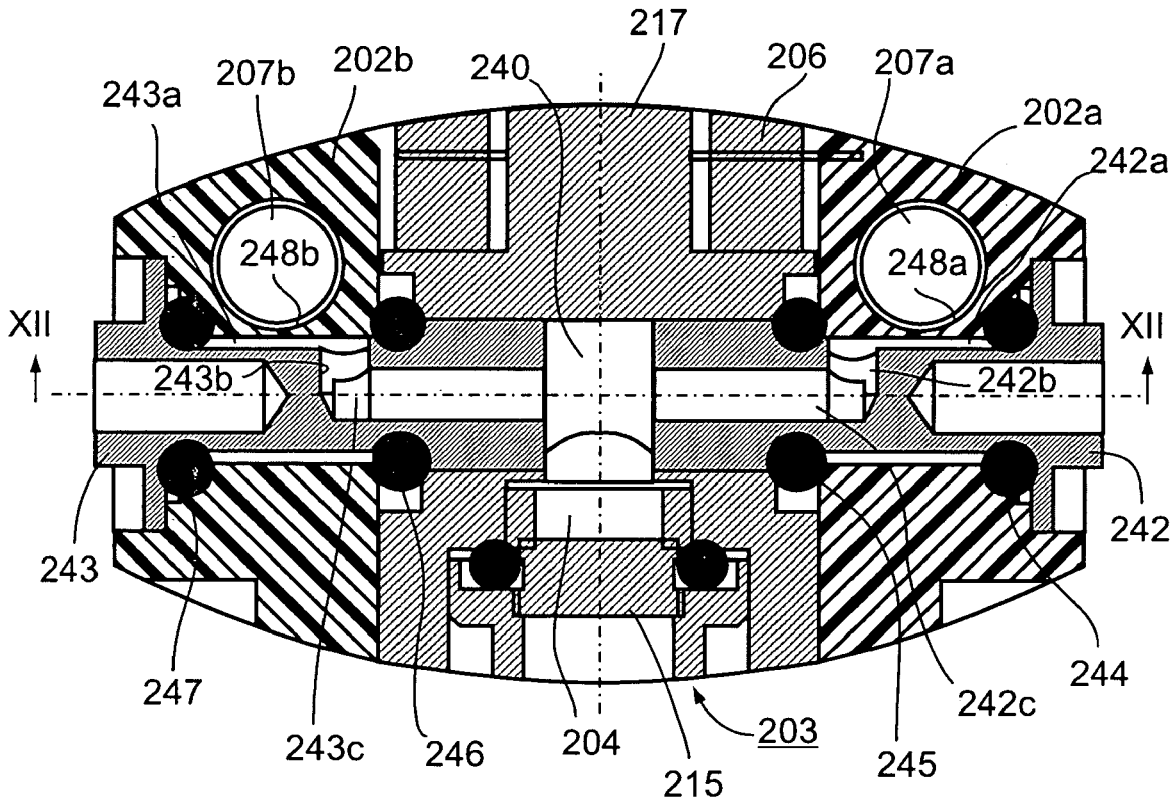
Figure 12:
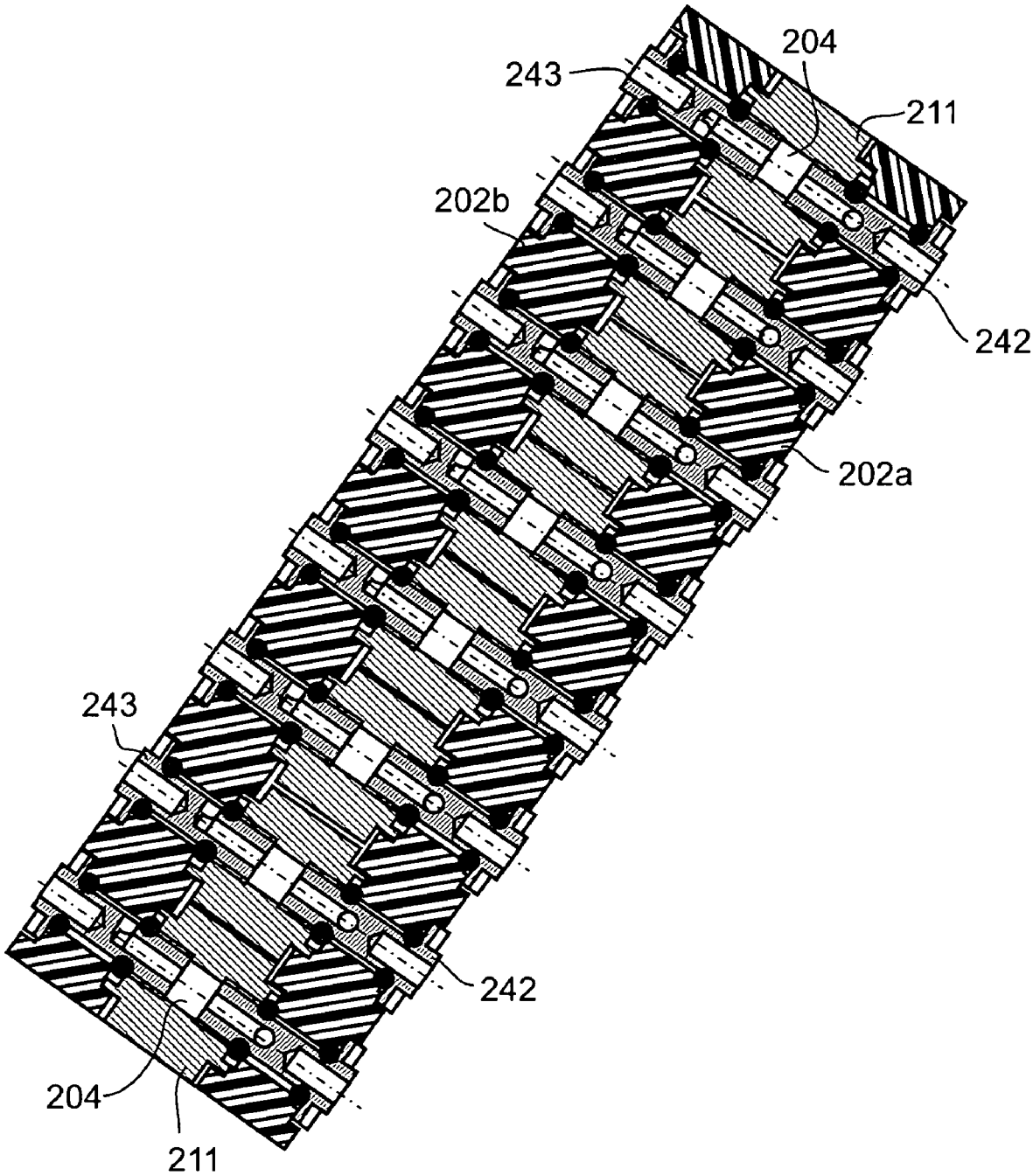

FIGS. 10 and 11 more particularly illustrate the inlet manifold 207*a* formed in mounting section 202*a*; the outlet manifold 207*b* formed in mounting section 202*b*; and the connecting passageways defining the T-connections between the jet modules. As shown particularly in FIG. 9, the inlet manifold 207*a* in mounting section 202*a* is supplied from the ink reservoir (not shown) via a coupling 235, and is closed at its opposite ends by plugs 236*a*, 236*b*; similarly, the outlet manifold 207*b* in mounting section 202*b* is supplied from the ink reservoir via coupling member 237 and is closed at its opposite ends by plugs 238*a*, 238*b*.

For producing a T-connection of each jet module 203 with the inlet and outlet manifolds 207*a*, 207*b*, the body member 211 of each jet module is formed with a transverse bore 240 communicating with the nozzle inlet 204 of the respective jet module. In addition, the two mounting sections 202*a*, 202*b* are each also formed with a bore 241*a*, 241*b* (FIG. 9) for each jet module and aligned with bore 240 of the respective jet module. A plurality of pins 242, one for each jet module 203, are passed through their respective bores 241*a* of mounting section 202*a* and are threadedly received within one side of bore 240 of the respective jet module 203, for securing mounting section 202*a* to one side of all the jet modules 203. Another set of pins 243, one for each jet module 203, are similarly passed through their respective bores 241*b* in mounting section 202*b* and are threadedly received within the opposite side of bore 240 of the jet modules 203 to secure mounting section 202*b* to the printing heads. As further shown in FIG. 9, the printer head assembly further includes: O-rings 244 between pins 242 and mounting section 202*a*, O-rings 245 between mounting section 202*a* and the respective side of jet modules 203, O-rings 246 between the opposite of the jet modules and mounting section 202*b*, and O-rings 247 between the latter mounting section and the other group of pins 243.

It will thus be seen that the two sets of pins 242, 243 secure the two mounting sections 202*a*, 202*b* together with the linear array of jet modules 203 inbetween. Pins 242, 243 also define, with the two mounting sections 202*a*, 202*b* and the jet modules 203 inbetween, the T-connection of each jet module with the inlet manifold 207*a* in mounting section 202*a*, and the outlet manifold 207*b* in mounting section 202*b*.

The latter is more particularly illustrated in FIGS. 10 and 11. Thus, as particularly shown in FIG. 11, each of the pins 242 is of reduced outer diameter to define, with respect to bore 241*a*, an axially-extending space 242*a* on its outer surface between O-rings 244 and 245. Each pin 242 is further formed with a radial bore 242*b* establishing communication between space 242*a*, and with an axial bore 242*c* at the inner end of the pin and communicating with the nozzle inlet 204 for supplying ink thereto. Similarly, the other set of pins 243 at the opposite side of the assembly also defines an axial space 243*a* on its outer surface between O-rings 246 and 247, a radial bore 243*b*, and an axial bore 243*c* communicating with the jet module outlet for re-circulating the ink.

As further shown in FIG. 11, each of the manifolds 207*a*, 207*b* includes an opening, shown at 248*a*, 248*b*, respectively, for each jet module 203 and communicating with the opposite sides of the jet module inlet 204 via passageways 242*a*, 242*b*, 242*c* at one side, and passageways 243*a*, 243*b*, 243*c* at the opposite side. Such an arrangement thereby defines a T-connection, similar to that of FIGS. 5–8, connecting each jet module with the inlet and outlet manifolds 207*a*, 207*b*.

Although the construction illustrated in FIGS. 9–12 does not include the two-part mounting for the nozzles 205 to facilitate their cleaning, as described above with respect to FIGS. 5–8, it will be appreciated that this feature could also be included in the embodiment of FIGS. 9–12. The embodiment of FIGS. 9–12 does include the filter 215, the O-ring 216, and the stem 217 at the opposite side of the body member 211 of each jet module 203 for mounting the perturbation device 206, and also for mounting a counterweight 219 separated from the perturbation device by a separator disc 220.

Figure 13:
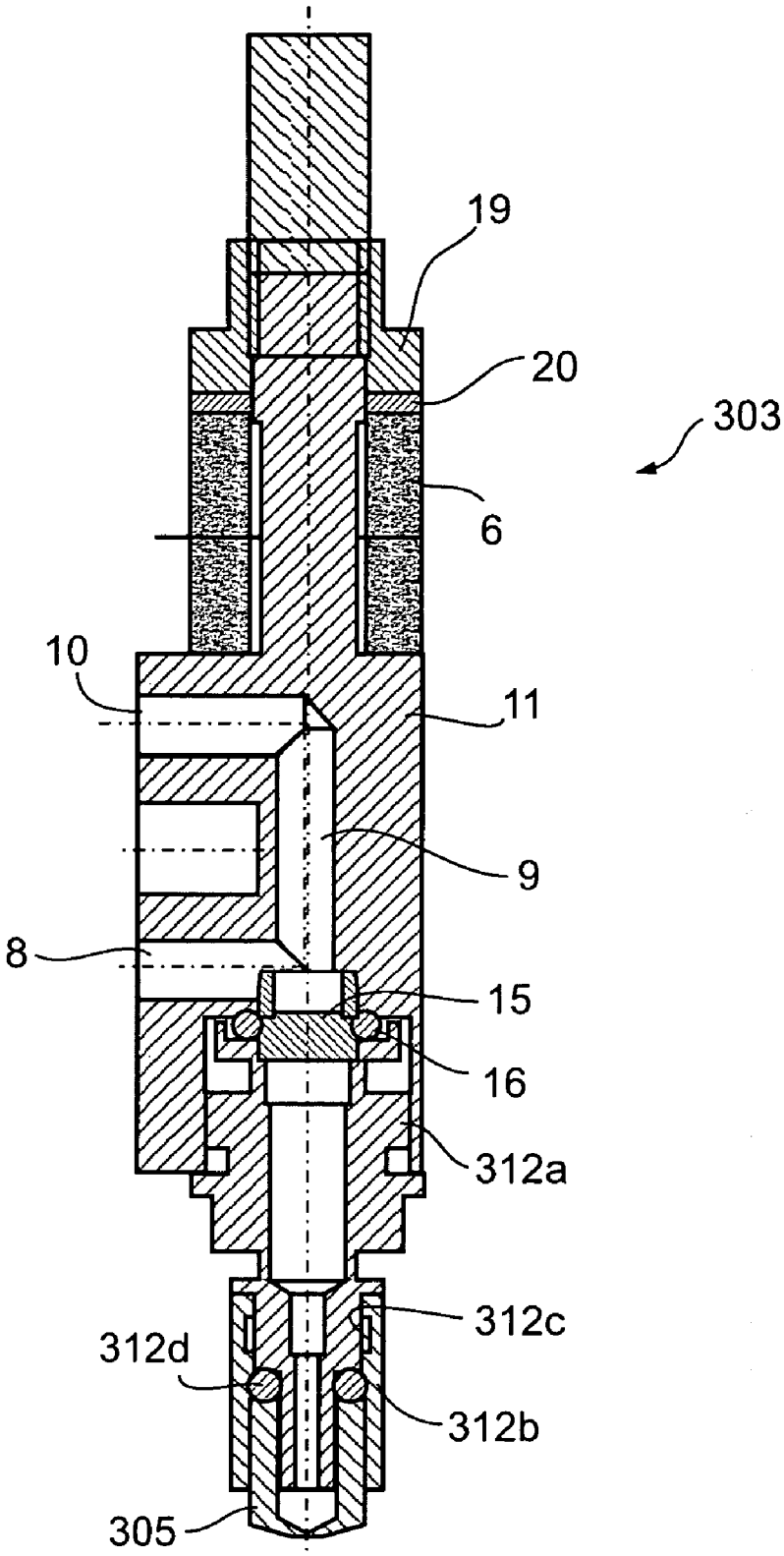
FIG. 13 illustrates a jet module constructed in accordance with a third embodiment of the invention.

The Embodiment of FIG. 13

FIG. 13 illustrates a jet module, therein generally designated 303, of the prior art construction illustrated in FIG. 3, except that it includes the two-part nozzle holder of FIGS. 5–8 for securing the nozzle in the manner permitting it to be conveniently disassembled and cleaned as and when desired without the need for extensively disassembling the jet module or removing it from operation for a substantial period of time for purposes of cleaning the jet module.

Thus, as shown in FIG. 13, the holder for the nozzle 305 is constructed of a main section 312*a*, a sleeve 312*b* threadedly received on the main section by threads 312*c* for conveniently removing the nozzle 305 from the holder as and when desired for cleaning purposes. The construction illustrated in FIG. 13 further includes the O-ring 312*d* between holder section 312*c* and the nozzle 305 for providing a sealed coupling with the nozzle, as described above with respect to FIG. 7. The remaining construction may be as described above with respect to FIG. 3, and therefore its parts are identified by the same reference numerals.

While the invention has been described above with respect to several preferred embodiments, it will be appreciated that these are set forth merely for purposes of example, and that many other variations, modifications and applications of the invention may be made.

What is claimed is:

1. Ink jet printing apparatus, comprising:

a linear array of jet modules each including an inlet for receiving ink, an outlet for re-circulating the ink, a nozzle for discharging ink in the form of droplets, and a perturbation device for causing a continuous stream of ink droplets to be discharged from the respective nozzle;

and an ink supply system including an inlet manifold, an outlet manifold, and a plurality of connecting passageways connecting said jet modules in parallel between the inlet and outlet manifolds;

characterized in that said inlet and outlet manifolds are formed in a body member exposed in alignment with said linear array of jet modules and formed with a plurality of bores for receiving said linear array of jet modules;

and said connecting passageways connect the inlet of each jet module to said inlet manifold and the outlet of each jet module to said outlet manifold, such as to define a T-connection of each jet module with said inlet and outlet manifolds.

2. The apparatus according to claim 1, wherein each of said jet modules has a vertically-extending longitudinal axis, and wherein said inlet and outlet manifolds both have longitudinal axes extending horizontally, parallel to each other in a common horizontal plane on opposite sides of said jet modules.

3. The apparatus according to claim 1, wherein said body member is further formed with a linear array of nozzle inlets for said linear array of jet modules, said plurality of connecting passageways including one group from said nozzle inlets to said inlet manifold, and a second group from said nozzle inlets to said outlet manifold.

4. The apparatus according to claim 3, wherein each of said jet modules is formed with a T-shaped connecting passageway having a horizontal leg communicating at its opposite ends with said inlet and outlet manifolds, and a vertical leg centrally off said horizontal leg and leading to its respective nozzle.

5. The apparatus according to claim 3, wherein said perturbation device for each jet module is a piezoelectric transducer, and wherein each jet module is further formed with a mounting for said piezoelectric transducer above the jet module inlet.

6. The apparatus according to claim 5, wherein each jet module further includes a counterweight supported thereon above said piezoelectric transducer.

7. The apparatus according to claim 3, wherein said mounting device is formed with a linear array of bores receiving said linear array of jet modules with said inlet and outlet manifolds of said mounting member located on opposite sides of said jet modules.

8. The apparatus according to claim 3, wherein said mounting device includes two sections secured together with said array of jet modules inbetween.

9. The apparatus according to claim 8, wherein one of said sections includes said inlet manifold in the form of a continuous channel plugged at its opposite ends, and the other of said sections includes said outlet manifold also in the form of a continuous channel plugged at its opposite ends.

10. The apparatus according to claim 9, wherein each of said sections is formed with an opening for each of said jet modules and includes a pin in each of said openings formed with a connecting passageway connecting the respective manifold to the respective side of the jet module inlet.

11. The apparatus according to claim 9, wherein said two sections of the mounting device are made of a plastic material having a relatively low mass.

12. The apparatus according to claim 1, wherein each of said jet modules includes a filter between its inlet and nozzle.

13. The apparatus according to claim 1, wherein each of said nozzles is removably attached to the jet module by a coupling sleeve which permits convenient detaching of the nozzle for cleaning purposes.

14. The apparatus according to claim 1, wherein said jet modules are equally spaced from each other in said linear array; and wherein said apparatus further includes a gutter in every other space between said jet modules such that each gutter is shared by two jet modules on the opposite sides of the respective gutter.

15. Ink jet printing apparatus, comprising:

a linear array of jet modules each including an inlet for receiving ink, an outlet for re-circulating the ink, a nozzle for discharging ink in the form of droplets, and a perturbation device for causing a continuous stream of ink droplets to be discharged from the respective nozzle;

and an ink supply system including a body member formed with an inlet manifold, an outlet manifold, and a plurality of connecting passageways connecting said jet modules in parallel between the inlet and outlet manifolds;

each of said nozzles being removably attached to the jet module by a coupling sleeve fixed to said body member and formed with internal threads engageable with external threads formed in the jet module to permit convenient detaching of the nozzle for cleaning purposes.

16. The apparatus according to claim 15, wherein said connecting passageways connect the inlet of each jet module to said inlet manifold and the outlet of each jet module to said outlet manifold, such as to define a T-connection of each jet module with said inlet and outlet manifolds.

17. The apparatus according to claim 16, wherein each of said jet modules has a vertically-extending longitudinal axis, and wherein said inlet and outlet manifolds both have longitudinal axes extending horizontally parallel to each other in a common horizontal plane on opposite sides of said jet modules.

18. Ink jet printing apparatus, comprising:

a linear array of jet modules each including an inlet for receiving ink an outlet for re-circulating the ink, a nozzle for discharging ink in the form of droplets, and a perturbation device for causing a continuous stream of ink droplets to be discharged from the respective nozzle; each of said jet modules being equally spaced from each other in said linear array;

an ink supply system including an inlet manifold, an outlet manifold, and a plurality of connecting passageways connecting said jet modules in parallel between the inlet and outlet manifolds;

and a gutter only in every other space between said jet modules such that each gutter is shared by two jet modules on its opposite sides thereby enabling a more compact construction by substantially reducing the number of gutters in the apparatus.

19. The apparatus according to claim 18, wherein said connecting passageways connect the inlet of each jet module to said inlet manifold and the outlet of each jet module to said outlet manifold, such as to define a T-connection of each jet module with said inlet and outlet manifolds.

20. The apparatus according to claim 19, wherein each of said jet modules has a vertically-extending longitudinal axis, and wherein said inlet and outlet manifolds both have longitudinal axes extending horizontally parallel to each other in a common horizontal plane on opposite sides of said jet modules.

* * * * *